US005772467A

United States Patent [19]

Burgess

[11] Patent Number: 5,772,467

[45] Date of Patent: Jun. 30, 1998

[54] TERMINAL FREE CONNECTOR AND METHOD

[75] Inventor: James P. Burgess, Troy, Mich.

[73] Assignee: Alcoa Fujikura Ltd., Brentwood, Tenn.

[21] Appl. No.: 658,218

[22] Filed: Jun. 4, 1996

[51] Int. Cl.[6] ..... H01R 9/07

[52] U.S. Cl. ..... 439/493; 439/67

[58] Field of Search ..... 439/67, 77, 493, 439/404

[56] References Cited

U.S. PATENT DOCUMENTS

| | | | |
|---|---|---|---|
| 2,410,961 | 11/1946 | Carson | 287/78 |
| 2,458,413 | 1/1949 | Pennell | 24/135 |
| 3,065,446 | 11/1962 | Robb et al. | 339/184 |
| 3,088,090 | 4/1963 | Cole et al. | 339/150 |
| 3,090,028 | 5/1963 | Hall et al. | 339/174 |
| 3,149,896 | 9/1964 | Hall | 339/75 |
| 3,319,216 | 5/1967 | McCullough | 439/493 |
| 3,594,715 | 7/1971 | Dumesnil | 339/244 |
| 3,851,294 | 11/1974 | Palazzetti et al. | 439/493 |
| 3,980,375 | 9/1976 | LaMarche | 339/61 M |
| 4,062,616 | 12/1977 | Shaffer et al. | 439/404 |
| 4,684,195 | 8/1987 | Anderson et al. | 439/404 |
| 4,784,615 | 11/1988 | Teng-Hong | 439/496 |
| 4,859,189 | 8/1989 | Petersen et al. | 439/67 |
| 5,212,348 | 5/1993 | Gibson | 174/74 R |

*Primary Examiner*—J. J. Swann

*Attorney, Agent, or Firm*—Gifford, Krass, Groh, Sprinkle, Patmore, Anderson & Citkowski, P.C.

[57] ABSTRACT

A terminal free electrical connector. The connector includes a housing having a plurality of apertures formed therein for the introduction of electrical leads. A wire frame fits into the housing and has a plurality of arrayed throughbores, into which the leads are inserted. The wire frame includes a slot which leaves a portion of each lead exposed. Electrical contact may thus be maintained between the exposed portions of the leads in the wire frame and either a mating electrical connector, or a flat contact surface. A method connecting electrical leads without the use of terminals is also disclosed.

4 Claims, 3 Drawing Sheets

40
30
28a
24
22
40
38
16
36a
18
28a
22a
23
23
36a
22
42
20
21
23a
21
32
28b
15b
42
36
28b
26
14
14
14
15a
36

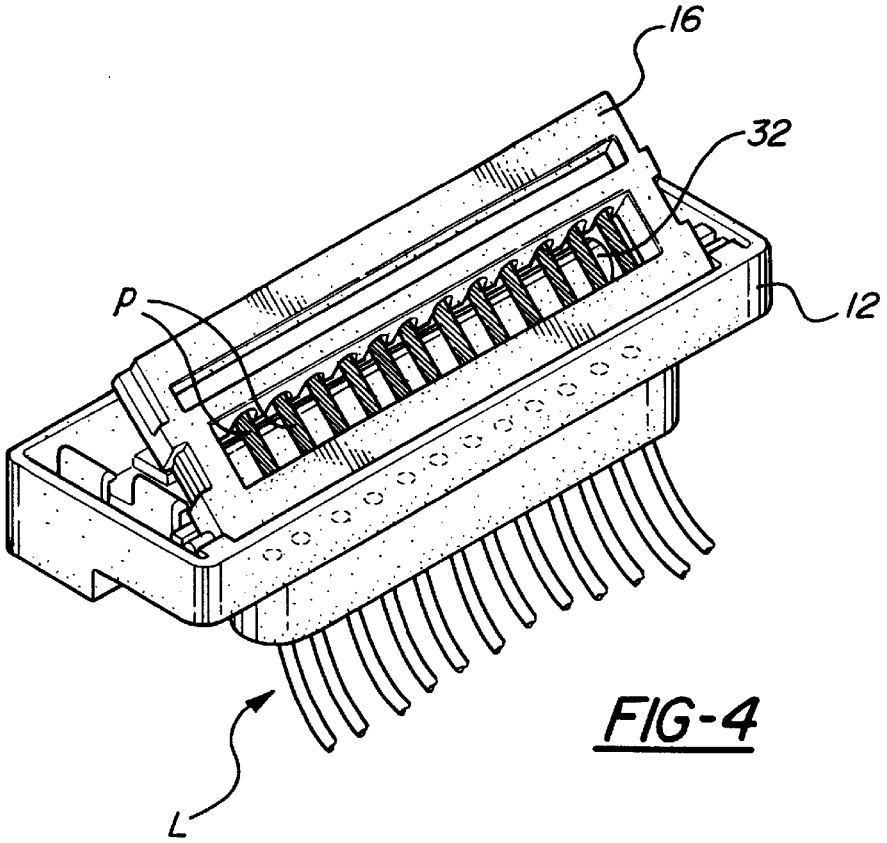
FIG-4
FIG-5
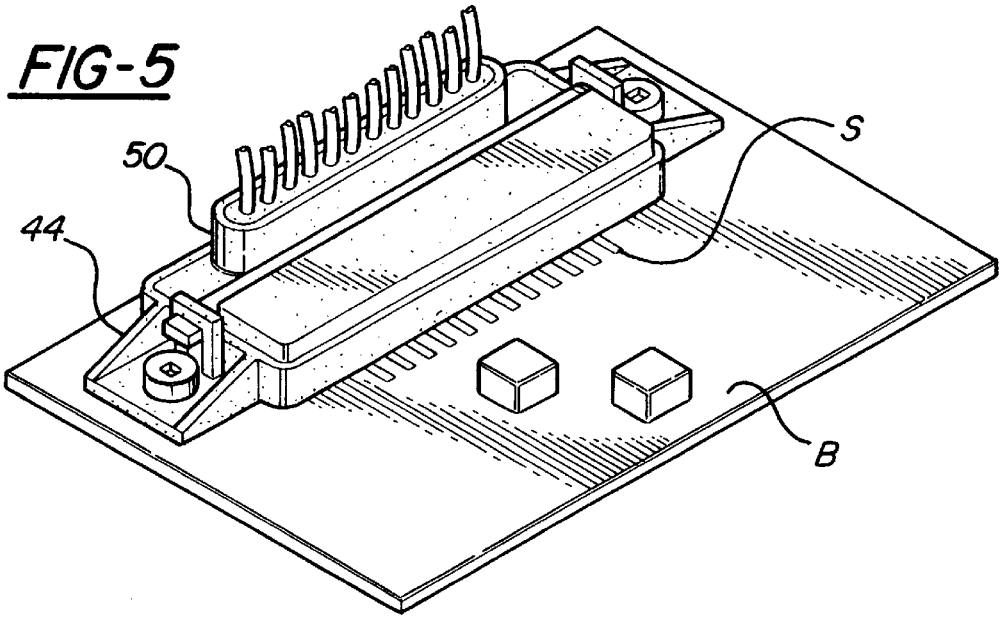

TERMINAL FREE CONNECTOR AND METHOD

FIELD OF THE INVENTION

This invention concerns the field of electrical connectors, and, more particularly, such an electrical connector which is free of terminals and which permits making direct electrical contact with a similar terminal free connector or exposed contacts on a circuit board.

DESCRIPTION OF THE RELEVANT PRIOR ART

Electrical connection between various components in automotive electrical systems is generally by way of multi-terminal connectors. The terminals of such connectors normally are configured either as pins or sockets so that mating terminal connectors may be engaged to form electrical contact between the terminals thereof.

While such terminal connectors are extremely useful, there are situations where it would be preferable to provide connectors which do not have terminals. Such connectors are designed so that electrical contact is made directly between exposed portions of the electrical leads involved, or, alternatively, between exposed leads and contact strips on other elements, such as circuit boards. In particular, it may be desirable to provide such a terminal free connector because, by eliminating the bulky terminals, the connector may be configured to have a much lower profile, a particularly desirable trait in an electrical connector which is to be disposed inside the interior of a vehicle.

The general concept of establishing a pressed together connection between current carrying wires is well known, as is the concept of providing housings for maintaining the wires in a terminal free connection. For example, U.S. Pat. No. 2,458,413 discloses a pair of electrical wires maintained in a pressed together connection by a housing which includes a screw operating through a washer for maintaining contact between the wires. U.S. Pat. No. 3,594,715 shows, in FIG. 5, a terminal free connector which supports and encloses two multi-stranded wires in a pressed together relationship. U.S. Pat. No. 3,980,375 discloses a terminal block having a number of metallic pins, each of which engages a conductive trace on a flexible circuit. The housing of the terminal block is formed from an elastomeric material and operates to maintain the conductors in a pressed together relationship. U.S. Pat. No. 4,784,615 discloses the pressed together connection of flexible circuit elements. As is shown specifically in FIG. 6, the flexible conductors 18 are locked together in contact by the interaction of a resilient member 34 with another supporting member 16. The '615 patent discloses at Column 2, Lines 3–10 a prior art pressure contact connector, namely, U.S. Pat. No. 2,410,961. The '961 patent discloses an electrical connector described as having particular utility for automobiles, in which a pressed together connection of two wires is established by a housing which includes a plunger member 16.

U.S. Pat. Nos. 3,065,446; 3,088,090; 3,090,028; and 3,149,896 all disclose various housings for establishing connection between multi-terminal flat strip cables. The housings include support and biasing elements. U.S. Pat. No. 5,212,348 shows a flat, multi-conductor cable which is partially stripped, but there is no teaching in this patent of interconnection of this cable with another; the partial stripping is carried out for purposes of maintaining cable alignment during terminal forming procedures.

However, none of the prior art described above discloses a multi-wire terminal-less connector which provides certain and sure contact between the wires thereof and a mating connector or other types of exposed contacts suitable for use in the environment of a vehicular electrical system. Thus, there is a need for such a terminal-less connector, and particularly for one which is formed of inexpensive to manufacture components which are, themselves, easy to assemble together into a connector.

SUMMARY OF THE INVENTION

Disclosed and claimed herein is a terminal free electrical connector and method of forming a terminal free electrical connection. It includes a housing having at least one aperture (and preferably a plurality of such apertures) formed therethrough for introducing an electrical lead through each such aperture.

In one embodiment of the connector of the present invention, the housing includes opposed side and opposed end walls and a bottom surface, said walls and surface together forming a hollow enclosure. The apertures are formed through the bottom surface as a linear array for introduction of the plurality of electrical leads.

The electrical connector of the present invention further includes a wire frame insertable into the housing. The wire frame includes at least one throughbore for receiving each electrical lead. Preferably, the wire frame has a plurality of such throughbores linearly arrayed which are alignable with the plurality of apertures. The throughbores may be oriented to align with a short axis of the frame, or they may be oriented at an angle with respect thereto. The wire holder also includes a slot formed therein, the slot being oriented normal to the longitudinal throughbores. Each lead passes through the slot, thus leaving a portion of the lead exposed therein. If the insulation from the exposed portion is stripped, the exposed portion forms a contact surface for contact with a mating connector to establish an electrical path therebetween. The end of each electrical lead abuts against the blind end of the throughbore disposed below the slot so as to retain the end of the wire therein.

The wire frame may take a variety of forms. In one embodiment, it is provided in the form of a wire enclosure and cover which are snap fit together. The wire cover may further include a wedge which is insertable into a wedge slot formed in the cover near the blind ends of the aligned throughbores to help retain the leads disposed therein.

The terminal free electrical connector further includes means for retaining the wire frame in the housing. Preferably, the frame is retained inside the hollow enclosure of the housing by means of mating hinge members formed on the frame and on the housing so that the frame may be pivotally retained within the hollow enclosure of the housing. In order to retain the leads within the connector, an elongated resilient member is provided which is sized and configured to be retained between the housing and the exposed portions of the wires. It provides a spring force which pushes against the exposed portions of the leads and partially forces them out of the slot for improved electrical contact. A boss is formed on the bottom surface of the housing and serves as a dimensioning element. The resilient member is disposed on top of the boss, and the boss functions to raise the level of the resilient member so that it engages the leads and pushes against them as previously described. Alternatively, the housing may be configured to include an integral lead retaining member which performs the function of the resilient member and boss.

The connector of the present invention may also be configured as a male or female connector for mating engagement with an oppositely configured connector. The mating connectors may be designed so that their leads are angled in opposite directions. That is, a connector may be mated with a similar connector having exposed leads which angle in the opposite direction, so that each exposed portion of each lead of the first connector crosses the exposed portion of the mating lead of the second connector, thus improving the reliability of the electrical contact therebetween.

However, the use of the terminal-less connector of the present invention is not limited to establishing electrical contact between mating connectors. The connector may also be used to establish contact with flat contact strips, such as on a circuit board. This arrangement of terminal-less connector and flat contact board presents a particularly low profile.

BRIEF DESCRIPTION OF THE DRAWINGS

The following detailed description may best be understood by reference to the following drawings in which:

FIG. 4 is a rear view of the connector of FIG. 1 with the wire frame pivoted up from the housing; and FIG. 5 shows the connector of FIG. 1 installed onto a circuit board.

DETAILED DESCRIPTION OF THE PREFERRED EMBODIMENTS

Figure 1:
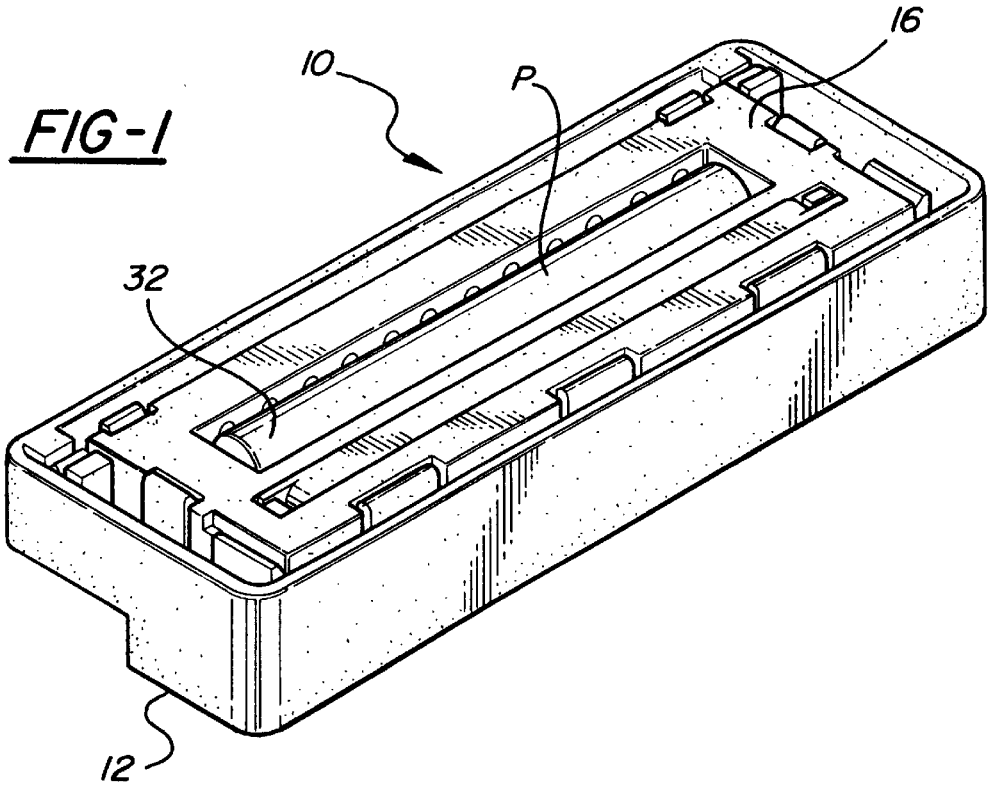
FIG. 1 is a front perspective view of the terminal-free connector according to the present invention without electrical leads installed therein.
Figure 2:
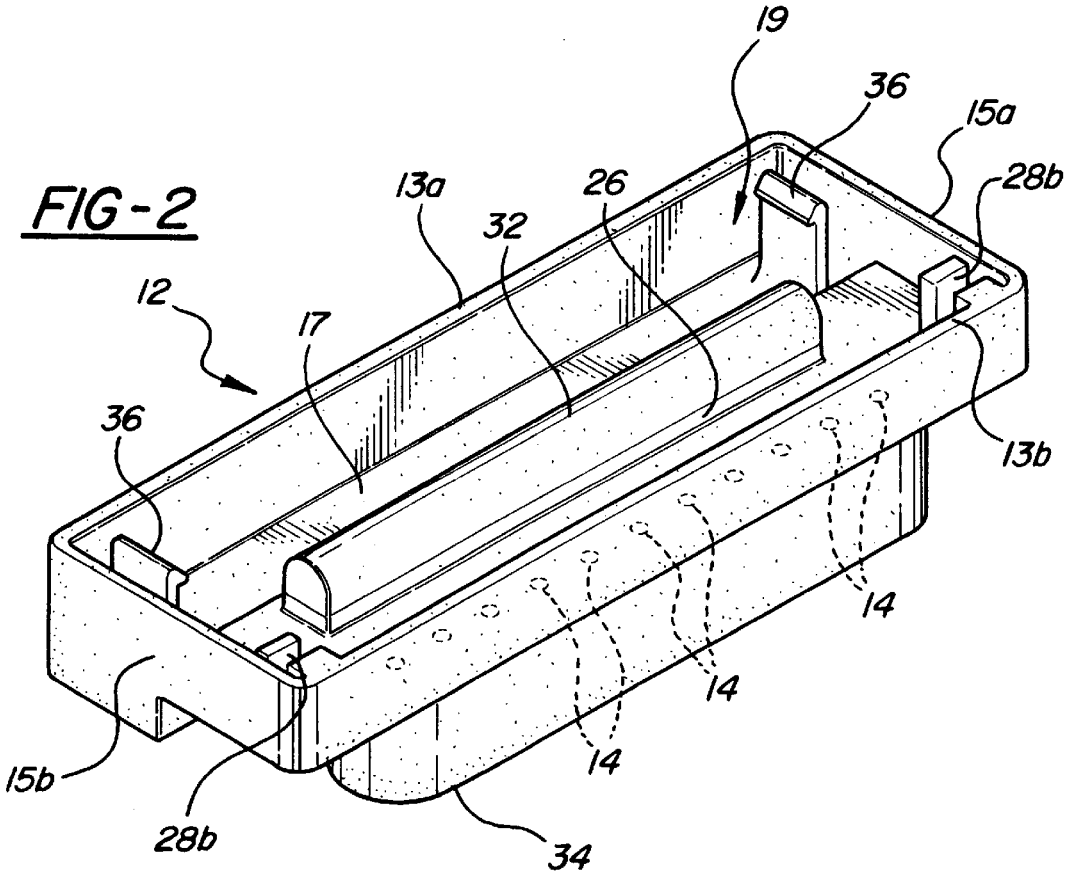
FIG. 2 is a rear perspective view of the housing of the connector of FIG. 1.
Figure 3:
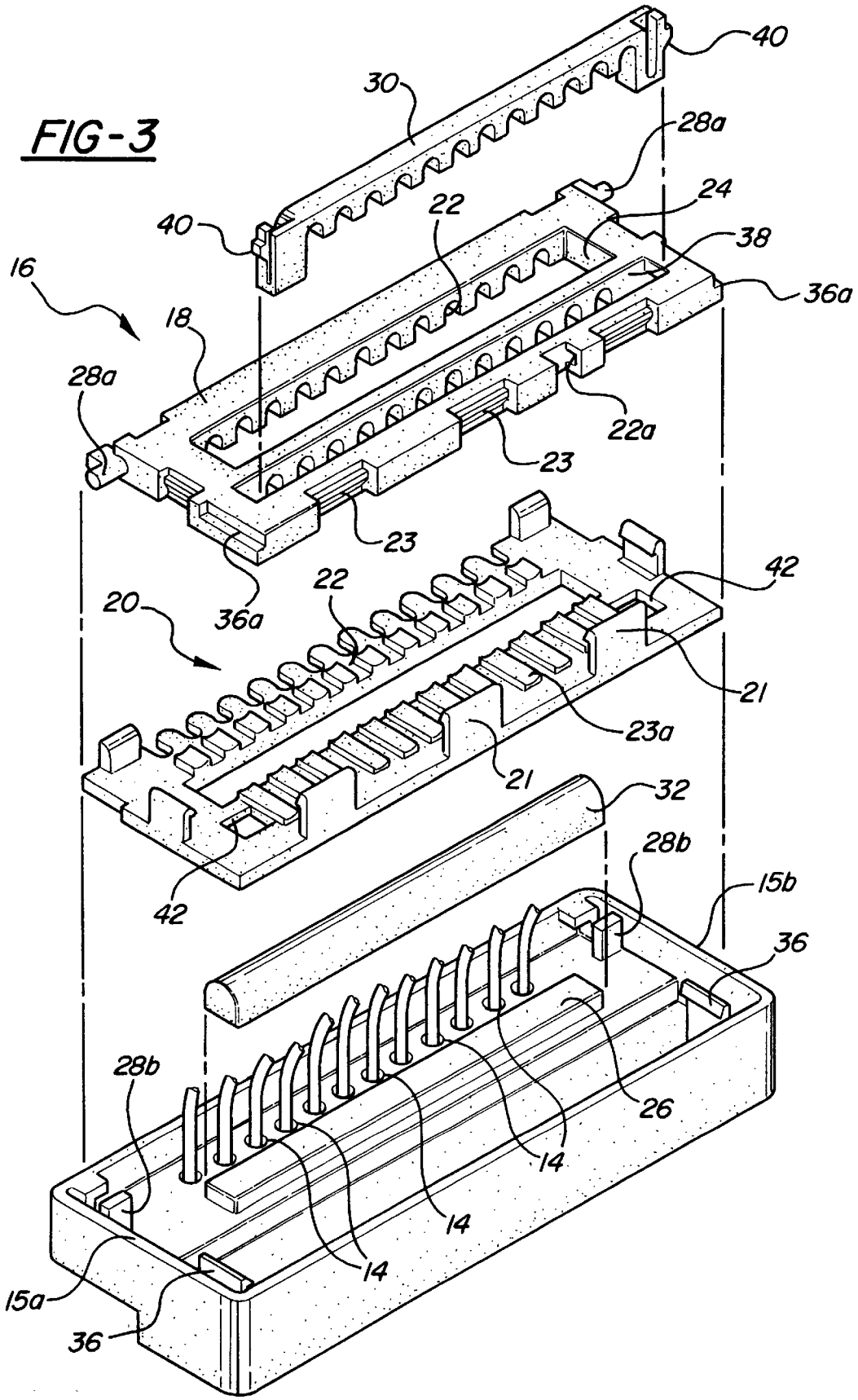
FIG. 3 is an exploded perspective view of the three part wire frame of the connector of FIG. 1.

Throughout the following detailed description, like numerals are used to reference the same element of the present invention shown in multiple figures thereof. Referring now to the drawings, and in particular to FIGS. 1–3, there is shown a terminal free connector 10 constructed according to the principles of the present invention. The connector 10 includes a housing 12 which has opposed side walls 13*a*, 13*b*, opposed end walls 15*a*, 15*b*, and a bottom surface 17 which, together with the side walls 13*a*, 13*b* and end walls 15*a*, 15*b*, cooperate to define a hollow enclosure 19. A linear array of apertures 14 are formed through the bottom surface 17 of the housing 12. A wall 34 is formed around the array of apertures 14 and extends away from the bottom surface 17, serving to guide leads which are to be threaded into the apertures 14 and to hold a rubber grommet 50 (shown in FIG. 5) which is shaped so as to act as a moisture seal around the wires.

As can best be seen in FIG. 3, the device 10 further includes a wire frame 16 which consists of three main parts: wire enclosure 18, cover 20, and wedge 30. The cover includes a plurality of fingers 21 which are snap fit into recesses 23 formed in the wire enclosure so that the cover 20 may be snap fit onto the wire enclosure 18. In this way, the wire frame 16 is much easier to manufacture than would be the case if it were provided as a single piece. Additionally, this arrangement makes it far easier to position the leads in the enclosure 18 and then enclose them with the cover 20.

A plurality of linearly arrayed throughbores 22 extend through the wire frame 16. Each throughbore 22 terminates in a blind end 22*a*. A slot 24 is formed in wire frame 16 above the blind ends 22*a* of the throughbores 22. The slot 24 is oriented perpendicular to the axis of the throughbores 22 so that their ends abut blind ends 22*a*. Electrical leads L which have been inserted into the throughbores 22 will first pass through the slot 24 so as to expose a portion P of each lead L in slot 24. Assuming that the ends of the lead have been stripped of insulation, the exposed portions P will then be available to make electrical contact with a mating lead.

An elongated resilient member 32 provides a spring force which pushes against the exposed portions P of the leads L as they pass through the slot 24. The resilient member 32 operates to thrust each exposed portion P of each lead L partially up through the slot 24 so that the exposed portions are slightly elevated with respect to the upper surface of the connector 10. This helps insure good electrical contact between the connector 10 and a mating connector circuit board.

A boss 26 is formed on the bottom surface 17 of the housing 12 (as best seen in FIG. 2) at a location thereon which corresponds to the location of the wire slot 24 when the wire frame is installed into the housing, as is shown in FIG. 1. Boss 26 is basically a dimensioning element for resilient member 32 which is disposed thereon. The height of boss 26 is a function of the resiliency (hardness number) of the material of which the resilient member 32 is formed. The more resilient the member 32 is, the greater is the height of boss 26, so that boss 26 can position resilient member 32 tightly against the leads L as previously described. Its height also determines the variability which the connector 10 can tolerate in fitting against another connector or circuit board.

Of course, it would be possible to design member 32 so that it would not require a dimensioning element. Moreover, its function could be incorporated into and made integral with housing 12. Additionally, resilient member 32 could be preattached to the housing 32 prior to final assembly. However, the depicted design has proven particularly easy to manufacture and assemble.

Mating hinge members 28*a* and 28*b* are provided on, respectively, the wire frame 18 and the housing 12. Thus, the wire frame 16 is pivotally retained within the housing 12. For example, in FIG. 4, the device 10 is shown with the wire frame 16 thereof pivoted up from the housing 12. In this position, the apertures 14 of the housing 12 are aligned with the throughbores 22 of the wire frame 16 so that the electrical leads may be easily threaded therethrough. After this has been accomplished, the resilient member 32 is placed on top of the boss 26 and the wire frame 16 is pivoted down into the hollow enclosure 19 of the housing 12. Resilient fingers 36 are provided on housing 12 which engage notches 36*a* on wire frame 16 in order to help retain the wire frame 16 in the closed position shown in FIG. 1.

Before the wire frame 16 is pivoted into the closed position in the housing 12, a wedge 30 (shown in FIG. 3) is inserted into wedge slot 38 formed in wire enclosure 18 of the wire frame 16. The wedge 30 is provided with a pair of wedge feet 40 which are engageable with wedge holes 42 formed in cover 20. In this way, the wedge 30 is retained in the connector 10. It operates to retain the ends of the leads L in the throughbores 22, and also simplifies the assembly of the connector 10. The wedge 30 is put in prior to closing the wire frame in order to latch the wires in place.

FIG. 5 is a perspective view which depicts a connector of the present invention installed onto a circuit board B including a plurality of exposed contact strips S. A bracket 44 is used which is specially configured to retain the connector so that it may be installed onto the circuit board B. In this way, the exposed portions P of the connector may be contacted with the contact strips S to form electrical paths therebetween. It will be noted that the arrangement depicted in FIG. 5 presents a particularly low profile.

Although not depicted, the throughbores 22 could be oriented at an oblique angle with respect to the housing, thus causing the exposed portions P of the inserted leads L also to have an angular relationship with respect to the housing. If a connector of the present invention with leads angled in one direction is mated with another similar connector having the leads thereof angled in the opposite direction, the respective exposed portions of the leads of the mating connectors will cross, thus establishing good electrical contact therebetween.

In a further refinement of the invention, the connector may be provided with additional grommets and seals to isolate the electrical contacts from the environment. Furthermore, instead of the flat profile shown in FIG. 1, the housing of the connector could be configured so that its outer rim extends above the level of the exposed leads to form a female connector Similarly, the level of the outer walls could be shortened relative to the level of the exposed leads to form a mating male connector. The connector includes a unique wire frame arrangement wherein a portion of each lead threaded through the frame is exposed, thus permitting good electrical contact. The connector also includes means for retaining the leads within the housing.

Thus, there has been described a terminal-less electrical connector which is low profile, easy to assemble, and provides good electrical contact with either a mating connector or a flat contact surface.

Thus, while the present invention has been described with regard to certain exemplifications and embodiments thereof, it is by no means limited to the exact depicted designs. Variations thereof may occur to one of skill in this field without departing from the scope of the present invention. For example, the wire frame may be designed somewhat differently than the three part version shown in the preferred embodiment. Furthermore, the means of attaching the frame into the housing may be other than the pivotal connection shown. For example, a snap fit therebetween may be provided. Thus, it is the claims appended hereto, and all reasonable equivalents thereof, rather than the exact depicted embodiments and exemplifications, which define the true scope of the present invention.

I claim:

1. A terminal free electrical connector comprising:

a housing including opposed side and opposed end walls and a bottom surface, said walls and surface together forming a hollow enclosure, said bottom surface having a plurality of arrayed apertures formed therethrough for introducing a plurality of electrical leads through said apertures;

a rectangular wire holder having hinge means, said holder being pivotally insertable into said enclosure, said wire frame including a plurality of aligned throughbores for receiving said plurality of electrical leads, said throughbores being alignable with said apertures of said housing, said wire frame further comprising a slot formed therein oriented normal said throughbores, said leads passing through said slots so as to expose portions of said leads therein, said exposed portions forming contact surfaces for contact with a mating connector to establish electrical paths therebetween;

a boss formed on the bottom surface of said housing at a location thereon such that, when said wire frame is retained in said housing, said boss is received in said slot;

a resilient member configured to be received in said slot and disposed therein between said boss and said exposed portions of said leads so as to position said leads in said slot; and a guide wall formed on a rear surface of said housing said guide wall surrounding said plurality of apertures for retaining a sealing grommet thereon.

2. The electrical connector of claim 1 wherein the side and end walls of said housing are shallow in depth relative to the length and width of the housing so as to give the housing a low profile.

3. The connector of claim 1 wherein the wire frame comprises a wire enclosure including a channel for receiving said electrical lead and a wire cover which is retained on said wire enclosure by a snap fit.

4. The electrical connector of claim 1 wherein each of said plurality of throughbores is oriented at an angle with respect to said frame.

* * * * *